United States Patent [19]

Fotinos et al.

[11] Patent Number: 5,073,196

[45] Date of Patent: Dec. 17, 1991

[54] NON-ACCELERATED IRON PHOSPHATING

[75] Inventors: Nicephoros A. Fotinos, Royal Oak; Gary D. Kent, Sterling Heights, both of Mich.

[73] Assignee: Henkel Corporation, Ambler, Pa.

[21] Appl. No.: 353,853

[22] Filed: May 18, 1989

[51] Int. Cl.[5] ..... C23F 7/14

[52] U.S. Cl. ..... 106/287.19; 148/247; 148/255

[58] Field of Search ..... 106/14.12, 1, 287.19, 106/287.29; 148/257, 247, 262, 255

[56] References Cited

U.S. PATENT DOCUMENTS

| | | | |
|---|---|---|---|
| 3,129,121 | 4/1964 | Rodzawich | 148/260 |
| 3,425,876 | 2/1969 | Steinbrecher | 148/262 |
| 4,017,335 | 4/1977 | Maloney | 148/260 |
| 4,110,129 | 8/1978 | Matsushima et al. | 148/247 |
| 4,148,670 | 4/1979 | Kelly | 148/247 |
| 4,181,539 | 1/1980 | Murakami et al. | 148/260 |
| 4,187,127 | 2/1980 | Yashiro et al. | 148/247 |
| 4,298,405 | 11/1981 | Saus et al. | 148/260 |
| 4,313,769 | 2/1982 | Frelin et al. | 148/262 |
| 4,496,404 | 1/1985 | King | 148/6.14 R |
| 4,497,666 | 2/1982 | Schapira et al. | 148/247 |
| 4,497,667 | 2/1985 | Vashi | 148/254 |
| 4,595,424 | 6/1986 | Hacias | 148/6.15 R |

FOREIGN PATENT DOCUMENTS

| | | | |
|---|---|---|---|
| 1265392 | 10/1986 | Canada | 117/92 |
| 0085626 | 8/1983 | European Pat. Off. | 148/247 |

*Primary Examiner*—William R. Dixon, Jr.
*Assistant Examiner*—Paul Marcantani
*Attorney, Agent, or Firm*—Ernest G. Szoke; Wayne C. Jaeschke; Norvell E. Wisdom, Jr.

[57] ABSTRACT

Iron phosphating solutions without accelerators give excellent quality coatings on cold rolled steel and galvanized steel substrates for promoting adhesion of subsequent paint and similar coatings, when the solutions include at least 0.01 g/L of dissolved anionic titanium.

20 Claims, No Drawings

NON-ACCELERATED IRON PHOSPHATING

FIELD OF THE INVENTION

The present invention relates to compositions and methods for iron phosphating in the absence of a conventional "accelerator" or oxidizing agent.

STATEMENT OF RELATED ART

Iron phosphating is a well-known and commercially well established process for preparing the surfaces of iron, steel, and other active ferrous metals, including those with zinc coatings, for painting. The process is generally performed by exposing the metal surface to be phosphated to an aqueous solution containing phosphoric acid and/or ions derived from phosphoric acid. In such solutions under proper conditions, iron begins to dissolve from the metal surface, and the resulting ions form insoluble phosphates with some of the phosphate ions from the solution, resulting in an adherent coating that consists predominantly of iron phosphate.

In the early days of phosphating, solutions as simple as those described above were commercially used, but it was soon discovered that better results could be obtained by adding to the solution a material with oxidizing power, in order to accelerate the dissolution of the iron and the formation of the phosphate coating. Nitrate and nitrite ions, peroxide, chlorate, hydroxylamine, and a variety of other materials including meta-nitrobenzene derivatives have been used as accelerators, also known as oxidants or oxidizing agents. Current commercial compositions and methods of iron phosphating with solutions containing accelerators generally produce high quality phosphate layers with coating weights between 0.2 and 0.9 grams per square meter ($g/m^2$) of surface phosphated.

DESCRIPTION OF THE INVENTION

In this description, except in the operating examples or where expressly stated to the contrary, all numbers describing amounts of materials or conditions of reaction or use are to be understood in all instances as modified by the word "about".

It has been found that high quality phosphate layers for paint adherence can be obtained from aqueous phosphating solutions containing no accelerators, provided that the solutions contain appropriate amounts of titanium containing anions. The layers formed are preferably thin, with coating weights of no more than 0.1 $g/m^2$, but the corrosion protection achieved by a combination of such phosphating and subsequent conventional painting is at least as good as that achieved with most conventional accelerated phosphating solutions that produce much thicker phosphate layers.

This invention can be used with any aqueous solution having a pH value between 3.5 and 6 and containing phosphoric acid and/or anions derived from phosphoric acid (i.e., phosphate, monohydrogen phosphate, and/or dihydrogen phosphate) in a combined concentration between 3 and 100 grams per liter (g/L) of solution. Preferably the solution has between 10 and 30 g/L of "total phosphate", which is used herein to mean the sum of its phosphoric acid, dihydrogen phosphate ion, monohydrogen phosphate ion, and phosphate ion concentrations. Alkali metal cations and ammonium ion are preferred as the counterions for any phosphate ions present, with sodium and ammonium especially preferred. Solutions according to the invention also contain the stoichiometric equivalent of from 0.01 to 1 g/L of dissolved titanium in the form of titanium containing anions, with hexafluorotitanate IV (i.e., $TiF_6^{-2}$) and $Ti_4O_9^{-2}$ anions preferred, the former being more preferred. The total content of dissolved titanium is preferably between 0.05 and 0.2 g/L. Solutions according to the invention also have a total acid number, defined and measured according to methods as known in the art, between 4 and 30 points, more preferably between 6 and 15 points, and they have a free acid or acid consumed number of not more than 1 point, preferably not more than 0.2 point. The points of total acid are defined as the number of milliliters ("ml") of 0.1N NaOH solution required to titrate a 10 ml sample of the phosphating solution to a phenolphthalein end point. The points of free acid are defined as the number of ml of 0.1N NaOH solution required to titrate a 10 ml sample of the phosphating solution to a bromocresol green end point. If the phosphating solution is already on the alkaline side of bromocresol green, then there is no free acid number, and the acid consumed number is the number of ml of 0.1N sulfuric acid required to titrate a 10 ml sample of the solution to an end point showing the acid color of bromocresol green.

If the solutions according to this invention are to be used for phosphating galvanized base metals or other active metal surfaces with a high proportion of zinc, it is preferred that the solutions also contain hydrofluoric acid, fluoride ions, and/or complex fluoride ions to give a total stoichiometric equivalent of 0.05 to 5 g/L dissolved fluoride. More preferably, the amount of dissolved fluoride is between 0.3 and 2 g/L. Ammonium bifluoride, with the chemical formula $NH_4HF_2$, is a preferred source of dissolved fluoride.

In connection with this invention, the phosphating process can be combined with cleaning in a single step. When this is preferred, the solutions according to the invention should additionally contain a surfactant, of one of the types and in an amount within the range generally known in the art.

Phosphating according to the invention is accomplished by contacting an active metal object to be treated with one of the solutions according to the invention, preferably at a temperature between 30+ and 70° C., more preferably between 40° and 55° C. Contact should be for a sufficient time to effect the deposition of a phosphate layer effective for the type of protection desired. Normally, a time between 15 seconds and 5 minutes will be effective; for spray application, a time between 30 and 90 seconds is preferred and a time between 45 and 75 seconds more preferred. Contact may be accomplished by any method, as generally known to those skilled in the art, such as spray, immersion, and combinations of methods.

The novel processes according to this invention may advantageously be combined with other processes already known in themselves, in order to achieve practical results. For example, the phosphating process according to this invention is particularly advantageous as a preparation of an active metal surface before painting. If the solution used for phosphating according to this invention does not contain a surfactant, the active metal surface to be phosphated should first be cleaned in a conventional manner, as well known in the art. Water rinsing between each stage of a combined series of chemical treatment or coating processes is normally practiced to prevent contamination of one type of treatment solution by the constituents of another type of treatment used earlier in the process cycle.

The practice of this invention may be further appreciated from the following, non-limiting, operating examples. The examples used one of the following process cycles:

Cycle A (Combined Cleaning and Phosphating)

1. Spray with solution according to the invention, at 49° C., for a total of 60 seconds contact time.
2. Spray with cold tap water for 30 seconds to rinse.
3. Spray for 30 seconds with either Parcolene® 60 (a commercial chromate-containing post treatment solution available from Henkel Corporation, Parker+Amchem Division, Madison Height, Mich.) or Parcolene® 95 (a commercial chromium-free post treatment solution available from the same source).
4. Spray with deionized water for 15 seconds to rinse.
5. Dry in an oven at 121° C. for 5 minutes.

Cycle B (Separate Cleaning and Phosphating Cycle)

1. Spray for 60 seconds with Parco® Cleaner 2331 (a commercial mildly alkaline cleaner available from Henkel Corporation, Parker+Amchem Division, Madison Height, Mich.).
2. Spray for 30 seconds with warm tap water to rinse.
3. Spray with solution according to the invention, at 49° C., for a total of 60 seconds contact time.
4. Spray with cold tap water for 30 seconds to rinse.
5. Spray for 30 seconds with either Parcolene® 60 (a commercial chromate post treatment solution available from Henkel Corporation, Parker+Amchem Division, Madison Height, Mich.) or Parcolene® 95 (a commercial chromium-free post treatment solution available from Henkel Corporation, Parker+Amchem Division, Madison Height, Mich.).
6. Spray with deionized water for 15 seconds to rinse.
7. Dry in an oven at 121° C. for 5 minutes.

Both Cycles A and B were normally followed by application of a conventional paint or similar coating according to procedures known in the art.

The compositions of the phosphating solutions used in the operating examples and in one comparison example are shown in Table 1.

The substrates used in the examples were rectangles about 10×30 cm cut from one of the following types of sheets: Type 1040 cold rolled steel, 24 gauge (designated "CRS"); hot dipped galvanized, minimum spangle, 22 gauge steel (designated "HDG"); and Type 3003 aluminum alloy.

The prepainting treatment conditions used in Examples 1-8 and Comparative Example 1C are shown in Table 2.

In addition to the phosphating conditions shown in Table 2, Comparative Examples 2C-6C using commercial materials were performed for further comparison against the solutions and processes of this invention. Comparative Example 2C used Cycle A with Parco® Coater 2557, a molybdate accelerated trimetal coater. Comparative Example 3C was the same as 2C except for using Cycle B. Comparative Example 4C used Cycle B and Bonderite® 1000, a chlorate accelerated iron phosphating solution, while Comparative Example 5C used Cycle A and Bonderite® 3212, an iron phosphating solution accelerated with m-nitrobenzene sulfonate ion. Comparative Example 6C was the same as 5C except for using Cycle B. All the commercial products mentioned in this paragraph are available from the Parker+Amchem Division of Henkel Corporation, Madison Heights, Mich.

The phosphate coating weights obtained in these examples and comparative examples are shown in Table 3.

Two types of conventional, organic polymer based, commercially available surface coatings were used after phosphating as described above. They were Duracron TM 200, a single step paint available from E. I. du Pont de Nemours & Co., and Guardsman TM 42-3000 Acrylic Flocoat followed by Guardsman TM 62-1202 Top Coat, both available from Guardsman Paint Co. of Grand Rapids, Mich. After surface coating as described, each panel was scribed vertically down its center with sufficiently deep scribe to penetrate into bare base metal, and the panels were subjected to salt spray testing according to ASTM Standard B 117 - 73 (Reapproved 1979). The degree of corrosion of the panels after salt spray was evaluated visually, with results as shown in Table 4. The entries in this table show the distances away from the scribe mark, in sixteenths of an inch, where corrosion of the panels occurred. If the corroded area was substantially uniformly wide along the scribe line, the same number is reported on both sides of the hyphen in the table. If the pattern of corrosion was more erratic, with frequent variations in width, the minimum width of the corroded area is given to the left of the hyphen and the maximum width to the right of the hyphen. If the corroded area was predominantly uniform in width but had a few spotty wider areas, the width of these areas is given as a superscript number to the principal entry in the table to the right of the hyphen. The two entries at each position in the table represent duplicate panels.

TABLE 1

Characteristics of Phosphating Solutions Used

| | Solution Type: | | | | |
|---|---|---|---|---|---|
| | I | II | III | IV | V |
| $NH_4H_2PO_4$, g/L | 12.9 | 12.9 | 12.8 | 4.7 | none |
| $NaH_2PO_4$, g/L | 0.28 | 0.28 | none | none | 8.0 |
| $NH_4HF_2$, g/L | 1.25 | 1.25 | 1.25 | 0.75 | none |
| $Na_2Ti_4O_9$, g/L | 0.28 | none | none | none | none |
| $H_2TiF_6$, g/L | none | none | 0.45 | 0.75 | 0.50 |
| Surfactant, g/L | 0.78 | 0.78 | 0.47 | 2.4 | 2.1 |
| Total Acid No. | 12.5 | 12.5 | 12.5 | 9.8 | 6.0 |
| Free Acid No. | 0.0 | 0.0 | 0.0 | 0.0 | 0.0 |
| pH | | | | | |

TABLE 2

Cleaning and Phosphating Process Conditions

| Example No. | Cycle Type | Phosphating Solution Type | Substrate(s) |
|---|---|---|---|
| 1 | A | I | CRS, HDG |
| 1C | A | II | CRS, HDG |
| 2 | B | I | CRS, HDG |
| 3 | A | III | CRS, HDG |
| 4 | B | III | CRS, HDG |
| 5 | A | IV | CRS, HDG |
| 6 | B | IV | CRS, HDG |
| 7 | A | V | CRS |
| 8 | B | V | CRS |

TABLE 3

Coating Weights Obtained in the Examples and Comparisons

| | Coating Weight in g/m² on: | |
|---|---|---|
| Example No. | CRS | HDG |
| 1 | 0.045 | 0.055 |
| 1C | 0.003 | 0.055 |

TABLE 3-continued

| Coating Weights Obtained in the Examples and Comparisons | | |
|---|---|---|
| | Coating Weight in g/m² on: | |
| Example No. | CRS | HDG |
| 2 | 0.097 | 0.119 |
| 3 | 0.058 | 0.051 |
| 4 | 0.061 | 0.048 |
| 5 | 0.083 | 0.083 |
| 6 | 0.097 | 0.038 |
| 7 | 0.042 | |
| 8 | 0.090 | |
| 2C | 0.254 | 0.006 |
| 3C | 0.224 | 0.003 |
| 4C | 0.469 | 0.074 |
| 5C | 0.234 | |
| 6C | 0.308 | |

TABLE 4

| Salt Spray Testing Results | | | | | | | | |
|---|---|---|---|---|---|---|---|---|
| | | Hours of Salt Spray: | | | | | | |
| | | 120 | 168 | 240 | 336 | 360 | 400 | 504 |
| Part A: with Duracron TM Surface Coat | | | | | | | | |
| Example 1 | CRS | | 1-1 | | 1-1 | | | 2-3 |
| | | | 0-1 | | 1-2 | | | 2-5 |
| | HDG | | 0-1 | | 1-1 | | | 1-2[3] |
| | | | 0-1 | | 1-1 | | | 1-2[3] |
| Comp. Ex. 1C | CRS | | 1-1 | | 2-3 | | | 3-5 |
| | | | 1-1 | | 2-2 | | | 3-4 |
| | HDG | | 0-1 | | 1-1 | | | 1-3 |
| | | | 1-1 | | 1-2 | | | 2-4 |
| Example 2 | CRS | | 0-1 | | 1-1 | | | 2-2 |
| | | | 0-1 | | 1-1 | | | 2-3 |
| | HDG | | 1-1 | | 1-1[2] | | | 1-3[4] |
| | | | 1-1 | | 1-2[3] | | | 1-5 |
| Example 3 | CRS | | 2-2 | | 6-8 | | | fail |
| | | | 2-2 | | 6-8 | | | fail |
| | HDG | | 1-1 | | 2-3 | | | 3-6 |
| | | | 1-1 | | 2-3[4] | | | 4-7 |
| Example 4 | CRS | | 1-2 | | 4-6 | | | 5-10 |
| | | | 1-2 | | 3-6 | | | 7-12 |
| | HDG | | 1-1 | | 1-2 | | | 2-5 |
| | | | 1-1 | | 1-2 | | | 2-5[7] |
| Example 5 | CRS | | 1-1 | | 1-2[3] | | | 3-5 |
| | | | 1-1 | | 1-2[3] | | | 3-4 |
| | HDG | | 0-1[2] | | 0-2[3] | | | 1-5 |
| | | | 0-1[2] | | 0-1[4] | | | 0-2[4] |
| Example 6 | CRS | | 1-1 | | 3-3 | | | 5-5[6] |
| | | | 1-1[2] | | 3-3 | | | 5-6 |
| | HDG | | 1-6 | | 5-11 | | | fail |
| | | | 2-3[4] | | 4-7[8] | | | fail |
| Example 7 | CRS | 1-1 | | 3-2 | | 4-6 | 5-9 | |
| | | 1-1 | | 3-3 | | 4-4 | 6-8 | |
| Example 8 | CRS | 1-1 | | 1-1 | | 2-2 | 3-3 | |
| | | 1-1 | | 1-2 | | 2-3 | 3-4 | |
| Comp. Ex. 2C | CRS | | 0-4 | | 6-10 | | | fail |
| | | | 3-4 | | 8-10 | | | fail |
| | HDG | | 1-1 | | 1-2 | | | 3-4 |
| | | | 1-1 | | 1-2[3] | | | 3-5 |
| Comp. Ex. 3C | CRS | | 3-4 | | 6-8 | | | fail |
| | | | 2-3 | | 6-8 | | | fail |
| | HDG | | 1-1 | | 1-2[3] | | | 2-3[4] |
| | | | 1-1 | | 1-2 | | | 3-4 |
| Comp. Ex. 4C | CRS | | 0-0 | | 0-1 | | | 0-1 |
| | | | 0-0 | | 0-1 | | | 0-1 |
| | HDG | | 1-1 | | 1-1 | | | 1-1[2] |
| | | | 0-1 | | 0-1 | | | 1-1 |
| Comp. Ex. 5C | CRS | 1-1 | | 1-4 | | 2-6 | 3-9 | |
| | | 1-1 | | 1-4 | | 4-7 | 5-9 | |
| Comp. Ex. 6C | CRS | 1-2 | | 3-4 | | 6-6 | 2-6 | |
| | | 1-1 | | 1-4 | | 2-6 | 3-10 | |
| Part B: with Guardsmen TM Surface Coating | | | | | | | | |
| Example 1 | CRS | | 0-1 | | 1-1 | | | 2-2 |
| | | | 0-1 | | 0-1 | | | 1-2 |
| | HDG | | 1-4 | | 2-7 | | | 2-10 |
| | | | 1-2 | | 1-3 | | | 1-3 |
| Comp. Ex. 1C | CRS | | 0-1 | | 0-1 | | | 0-1 |
| | | | 0-1[1] | | 1-3 | | | 2-6 |
| Comp. Ex. 1C | HDG | | 1-3 | | 2-5 | | | 2-6 |
| | | | 1-4 | | 2-7 | | | 2-8[10] |

TABLE 4-continued

| Salt Spray Testing Results | | | | | | | | |
|---|---|---|---|---|---|---|---|---|
| | | Hours of Salt Spray: | | | | | | |
| | | 120 | 168 | 240 | 336 | 360 | 400 | 504 |
| Example 2 | CRS | | 0-1 | | 0-1 | | | 1-2 |
| | | | 0-1 | | 1-1 | | | 2-3 |
| | HDG | | 4-6 | | 9-10 | | | fail |
| | | | 3-5 | | 5-7[7] | | | fail |
| Example 3 | CRS | | 1-1 | | 2-3 | | | 4-6 |
| | | | 1-1 | | 2-4 | | | 5-6 |
| | HDG | | 3-8 | | fail | | | fail |
| | | | 3-6[9] | | 4-12 | | | fail |
| Example 4 | CRS | | 1-1 | | 2-3 | | | 4-5 |
| | | | 1-1 | | 2-3 | | | 3-5 |
| | HDG | | 2-5 | | 3-11 | | | fail |
| | | | 1-5 | | 3-10 | | | fail |
| Example 5 | CRS | | 1-1 | | 2-3 | | | 4-6 |
| | | | 1-1 | | 2-3 | | | 5-6 |
| | HDG | | 1-1[2] | | 3-4 | | | 6-8 |
| | | | 1-1 | | 2-4 | | | 4-6 |
| Example 6 | CRS | | 1-1 | | 1-2 | | | 2-2[3] |
| | | | 1-1 | | 1-2 | | | 2-2[3] |
| | HDG | | 2-2 | | 5-6 | | | fail |
| | | | 2-2 | | 4-6 | | | 5-8 |
| Comp. Ex. 2C | CRS | | 1-3 | | 6-6 | | | fail |
| | | | 3-3 | | 6-7 | | | fail |
| | HDG | | 1-1 | | 1-2 | | | 3-4 |
| | | | 1-1 | | 1-2[3] | | | 3-5 |
| Comp. Ex. 3C | CRS | | 2-3 | | 5-7 | | | fail |
| | | | 2-3 | | 5-6 | | | fail |
| | HDG | | 1-1 | | 1-2 | | | 2-3[4] |
| | | | 1-1 | | 1-2[3] | | | 3-4 |
| Comp. Ex. 4C | CRS | | 0-0 | | 0-0 | | | 0-1 |
| | | | 0-0 | | 0-0 | | | 0-1 |
| | HDG | | 1-1 | | 1-3 | | | 3-4 |
| | | | 0-1 | | 1-2 | | | 1-4 |

The results in Table 4 indicate that Examples 1 and/or 2 according to the present invention provide better protection after subsequent surface coating on HDG substrate than any of the comparative examples, with the possible exception of 4C. On CRS substrate, most of the examples give results better than or at least as good results as those of any of the comparative examples except 4C, and that has a very high coating weight on this substrate, so that the solution needs to be replenished more frequently and at higher cost than with the examples according to this invention. The same advantage, although to a lesser degree, exists for Example 1 compared to Comparative Example 4C on HDG substrate.

What is claimed is:

1. A liquid composition of matter, consisting essentially of: (A) water; (B) from about 3 to about 100 g/L of dissolved total phosphate; (C) from about 0.01 to about 1.0 g/L stoichiometric equivalent of dissolved titanium, in the form of titanium containing anions; (D) up to about 5 g/L of total fluoride; and (E) up to about 50 g/L of surfactant, said composition having a total acid number between about 4 and about 30, a free acid or acid consumed number not greater than about 1, and a pH between about 2.5 and about 6.

2. A composition according to claim 1, containing between about 10 and about 30 g/L of dissolved total phosphate and between 0.05 and 0.2 g/L of dissolved anionic titanium and having a total acid number between about 6 and about 15 and a free acid or acid consumed number less than about 0.2.

3. A composition according to claim 2, containing between about 0.3 and about 2 g/L of total fluoride, said total fluoride being derived from the group consisting of hydrofluoric acid, ammonium bifluoride, and fluorotitanic acid; the dissolved total phosphate content of said composition being derived from the group consisting of ammonium dihydrogen phosphate and sodium dihydrogen phosphate; and the dissolved titanium content of said composition being derived from the group consisting of $H_2TiF_6$ and $Na_2Ti_4O_9$.

4. A composition according to claim 3, comprising surfactant of a type and in an amount effective for cleaning active metals from normal oil and grease contamination.

5. A composition according to claim 2, comprising surfactant of a type and in an amount effective for cleaning active metals from normal oil and grease contamination.

6. A composition according to claim 1, comprising surfactant of a type and in an amount effective for cleaning active metals from normal oil and grease contamination.

7. A process comprising steps of:

(I) contacting an active metal surface, under conditions effective to form a phosphate layer thereon, with a liquid composition consisting essentially of: (A) water; (B) from about 3 to about 100 g/L of dissolved total phosphate; (C) from about 0.01 g/L to about 1.0 g/L stoichiometric equivalent of dissolved titanium, in the form of titanium containing anions; (D) up to about 5 g/L of total fluoride; and (E) up to about 50 g/L of surfactant, said composition having a total acid number between about 4 and about 30, a free acid or acid consumed number not greater than about 1, and a pH between about 2.5 and about 6; and (II) covering the phosphate layer formed in step (I) with a protective coating having an organic polymer binder.

8. A process according to claim 7, wherein said liquid composition contains between about 10 and about 30 g/L of dissolved total phosphate and between 0.05 and 0.2 g/L of dissolved anionic titanium and has a total acid number between about 6 and about 15 and a free acid or acid consumed number less than about 0.2.

9. A process according to claim 8, wherein said liquid composition additionally contains between about 0.3 and about 2 g/L of total fluoride, said total fluoride being derived from the group consisting of hydrofluoric acid, ammonium bifluoride, and fluorotitanic acid; the dissolved total phosphate content of said liquid composition is derived from the group consisting of ammonium dihydrogen phosphate and sodium dihydrogen phosphate; and the dissolved titanium content of said liquid composition is derived from the group consisting of $H_2TiF_6$ and $Na_2Ti_4O_9$.

10. A process according to claim 9, wherein said liquid composition comprises surfactant of a type and in an amount effective for cleaning active metals from normal oil and grease contamination.

11. A process according to claim 8, wherein said liquid composition comprises surfactant of a type and in an amount effective for cleaning active metals from normal oil and grease contamination.

12. A process according to claim 7, wherein said liquid composition comprises surfactant of a type and in an amount effective for cleaning active metals from normal oil and grease contamination.

13. A process according to claim 12, wherein said contacting is with liquid composition at a temperature between about 30° and about 70° C. for a time between about 15 seconds and 5 minutes.

14. A process according to claim 11, wherein said contacting is with liquid composition at a temperature between about 30° and about 70° C. for a time between about 15 seconds and 5 minutes.

15. A process according to claim 10, wherein said contacting is with liquid composition at a temperature between about 30° and about 70° C. for a time between about 15 seconds and 5 minutes.

16. A process according to claim 9, wherein said contacting is with liquid composition at a temperature between about 30° and about 70° C. for a time between about 15 seconds and 5 minutes.

17. A process according to claim 8, wherein said contacting is with liquid composition at a temperature between about 30° and about 70° C. for a time between about 15 seconds and 5 minutes.

18. A process according to claim 7, wherein said contacting is with liquid composition at a temperature between about 30° and about 70° C. for a time between about 15 seconds and 5 minutes.

19. A process according to claim 18, wherein said contacting is with liquid composition at a temperature between about 40° and about 55° C. for a time between 45 and 75 seconds.

20. A process according to claim 10, wherein said contacting is with liquid composition at a temperature between about 40° and about 55° C. for a time between 45 and 75 seconds.

* * * * *